US011712728B2

(12) United States Patent
Kirov

(10) Patent No.: US 11,712,728 B2
(45) Date of Patent: Aug. 1, 2023

(54) AUTOMATIC MACHINE AND METHOD FOR PRODUCING REINFORCEMENT BLANKS

(71) Applicant: Valentin Todorov Kirov, Burgas (BG)

(72) Inventor: Valentin Todorov Kirov, Burgas (BG)

( * ) Notice: Subject to any disclaimer, the term of this patent is extended or adjusted under 35 U.S.C. 154(b) by 0 days.

(21) Appl. No.: 17/762,337

(22) PCT Filed: Dec. 4, 2019

(86) PCT No.: PCT/BG2019/000028
§ 371 (c)(1),
(2) Date: Mar. 21, 2022

(87) PCT Pub. No.: WO2021/068044
PCT Pub. Date: Apr. 15, 2021

(65) Prior Publication Data

US 2022/0362828 A1 Nov. 17, 2022

(30) Foreign Application Priority Data

Oct. 10, 2019 (BG) ..... 113011

(51) Int. Cl.
*B21D 11/12* (2006.01)
*B21D 7/12* (2006.01)
*B21D 7/14* (2006.01)

(52) U.S. Cl.
CPC ..... *B21D 11/12* (2013.01); *B21D 7/12* (2013.01); *B21D 7/14* (2013.01)

(58) Field of Classification Search
CPC ..... B21D 11/12; B21D 7/024; B21D 7/02; B21D 7/04; B21D 7/12; B21D 7/14
See application file for complete search history.

(56) References Cited

U.S. PATENT DOCUMENTS 3,563,283 A 2/1971 Mir
4,798,073 A * 1/1989 Dischler ..... B21D 7/022 72/219

(Continued)

FOREIGN PATENT DOCUMENTS

DE 1552860 A1 7/1969
DE 3416678 A1 1/1985

(Continued)

OTHER PUBLICATIONS

International Search Report for Application No. PCT/BG2019/000028, dated Jul. 1, 2020.

(Continued)

*Primary Examiner* — Debra M Sullivan
(74) *Attorney, Agent, or Firm* — Marshall, Gerstein & Borun LLP

(57) ABSTRACT

An automatic machine for producing reinforcement blanks, in particular of the type of reinforcement chairs, the automatic machine comprising two outer moulding units (A, A') and two inner moulding units (B, B'), wherein each of the moulding units (A, A' and B, B') comprises a pair of mandrels—a movable mandrel (8, 5) and a stationary mandrel (7, 6) connected to a power mechanism (11, 2). A method for producing reinforcement chairs from reinforcement sections comprising simultaneously forming the two support legs of the reinforcement chair in mutually opposite directions by the two outer moulding units (A, A') and then simultaneously forming the two vertical supports of the reinforcement chair by the two inner moulding units (B, B').

11 Claims, 6 Drawing Sheets

(56) References Cited

U.S. PATENT DOCUMENTS

| | | | | |
|---|---|---|---|---|
| 5,966,979 | A * | 10/1999 | Del Fabro | B21D 11/12 72/307 |
| 2007/0256466 | A1 | 11/2007 | Anagnostopoulos | |
| 2018/0221930 | A1* | 8/2018 | Del Fabro | B21F 1/006 |

FOREIGN PATENT DOCUMENTS

| | | | |
|---|---|---|---|
| EP | 0396489 | A2 | 11/1990 |
| EP | 0648577 | A1 | 4/1995 |
| EP | 1852195 | A2 | 11/2007 |
| FR | 2657547 | A1 | 8/1991 |
| FR | 2704784 | A3 | 11/1994 |

OTHER PUBLICATIONS

Examination Report for Indian Patent Application No. 202237015742, dated Jun. 8, 2022.
Opinion for Bulgaria Application No. 113011, dated Jul. 28, 2022.
Search Report for Bulgaria Application No. 113011, dated Jul. 28, 2022.

* cited by examiner

AUTOMATIC MACHINE AND METHOD FOR PRODUCING REINFORCEMENT BLANKS

CROSS-REFERENCE TO RELATED APPLICATION

This present application is the US national phase of International Patent Application No. PCT/BG/2019/000028, filed Dec. 4, 2019, which claims priority to Bulgaria Application No. 113011, filed Oct. 10, 2019. The priority application, BG 113011, is hereby incorporated by reference in its entirety.

TECHNICAL FIELD

The present invention relates to an automatic machine and a method for producing reinforcement blanks, in particular reinforcement blanks of the type of reinforcement chairs that may find application in the machining of reinforcing steel to reinforcement blanks used in construction.

BACKGROUND ART

An automatic machine for the production of stirrups, with the ability to bend in a third plane, allowing the production of chairs, is known. Said automatic machine consists of a metal body with built-in section for feeding a straight or already straightened metal rod to two bending mechanisms arranged in series one after the other, the bending in each of the bending rod being in a different plane. Each bending mechanism includes a stationary mandrel and a movable mandrel, and the actuation of the bending mechanisms can be performed by different power mechanisms—hydraulic motors, electric motors, cylinders. The bending mechanisms are mounted in a single housing and are positioned so that, when positioned in a working position, they are aligned, arranged in a single line and are capable of rotational movement required for the bending process. With this known automatic machine, the elements of the chair—two legs, two vertical supports and the upper horizontal part are formed sequentially. A reinforcing steel rod is fed to the first bending mechanism, where the rod is bent at 90 degrees to form one leg of the chair; after bending and returning the first bending mechanism to its initial position, the metal rod, including the bent element is automatically fed to the second bending mechanism positioned at such a distance that, after bending, the predetermined length of the vertical support is obtained. A new movement of the reinforcing rod is then carried out that provides the length of the upper horizontal part of the chair, after which the reinforcing rod returns to the first bending mechanism, where it is bent in a direction diametrically opposite to the first bending, forming the second vertical support with the required length and the second leg. The bending mechanism then automatically occupies a position allowing the reinforcing rod to move to the blade at a distance, which determines the length of the second leg of the chair, and the cutting of the rod completes the shaping of the chair. The automatic machine is manufactured by MEP s.p.a., Italy.

The disadvantages of this known automatic machine are the following: There is a need for reciprocating motions of the reinforcing steel between the two bending mechanisms and sequential bending and shaping of the individual parts of the chair, which requires high precision control and longer cycle time to produce one chair, resulting in low productivity. The complicated control creates the possibility of errors in dimensions and poor quality of the blanks.

DISCLOSURE OF INVENTION

An object of the present invention is to provide an automatic machine and a method for the production of reinforcement blanks that provide increased productivity with high quality of the reinforcement blanks.

Another object of the present invention is to provide an automatic machine and a method for the production of reinforcement blanks that ensure precise adherence to the dimensions of the reinforcement blanks.

These objects are accomplished by an automatic machine for the production of reinforcement blanks, in particular of the type of reinforcement chairs, from a reinforcement section, the automatic machine consists of a moulding module comprising two outer moulding units and two inner moulding units, as well as a reinforcement section locking mechanism positioned between the two inner moulding units and mounted on a support beam. Each of the outer moulding units comprises a pair of mandrels with parallel longitudinal axes—an outer stationary mandrel and an outer movable mandrel, each of the outer movable mandrels is fixed at one end to an arm and the outer stationary mandrel is fixed at the other end of the arm, and connected by a shaft with a power mechanism for rotation of the outer stationary mandrel around its axis. The power mechanism is mounted immovably on a mounting platform, which is fixed to the support beam. The pair of mandrels of the two outer moulding units are arranged relative to each other so that they are capable of bending the ends of the reinforcement section in two mutually opposite directions. Each of the two inner moulding units comprises a pair of mandrels with parallel longitudinal axes—a stationary mandrel and a movable mandrel, the plane passing through the longitudinal axes of the two mandrels being perpendicular to the plane passing through the longitudinal axes of the outer moulding mandrels. Each of the movable mandrels is fixed at one end to a second arm and the stationary mandrel is fixed at the other end of the second arm and connected by a second shaft to a second power mechanism for rotation said stationary mandrel around its axis. The second power mechanism is attached immovably to a second mounting platform, which in turn is attached immovably to the support beam. The mandrels of the inner and outer moulding units are arranged so that slits are formed between the stationary mandrels and the respective movable mandrels of the two moulding units to insert the reinforcement section. The automatic machine is provided with a controller and sensors for controlling the angle of bending of the reinforcement section are installed on each of the outer and the inner moulding units and also on the reinforcement section locking mechanism, said sensors are connected to the controller.

In one embodiment of the present invention, when the reinforcement section is bent upwards relative to the mounting platform for shaping the legs of the chair, the arm connecting the outer stationary mandrel and the outer movable mandrel of each of the outer moulding units is positioned below the level of the mounting platform and the reinforcement section and, when the reinforcement section is bent downwards relative to the mounting platform, the arm is positioned above the level of the mounting platform and the reinforcement section.

In another embodiment of the present invention, the movable mandrels and the stationary mandrels of the inner moulding units are positioned laterally on the second mounting platform on the side of the reinforcement section locking mechanism in close proximity and at a minimum distance from the end of the second mounting platform; and, when the reinforcement section is bent upwards to form the two vertical supports of the chair, each of the two stationary mandrels is positioned above the reinforcement section and each of the movable mandrels is positioned below the reinforcement section. When the reinforcement section is bent downwards, each of the two stationary mandrels is positioned below the reinforcement section, with the upper end of the stationary mandrel lying in one plane with the upper end of the second mounting platform, and each of the movable mandrels is positioned above the reinforcement section.

The power mechanisms are hydraulic cylinders and/or pneumatic cylinders and/or hydraulic motors and/or servomotors and/or electric motors and/or pneumatic motors.

In one embodiment of the present invention, the reinforcement section locking mechanism, located between the two inner moulding units, consists of a jaw comprising at least one pair of steel bodies, in one of which a protruding part is formed and in the other steel body, opposite to the protruding part, a concave part is formed, wherein the one steel body is attached immovably to the support beam and the other steel body is capable of sliding on a bed attached to the support beam by a third power mechanism connected to the steel body. In closed position, there is a slit between the two steel bodies for inserting and fixing the reinforcement section relative to the support beam.

In one preferred embodiment of the present invention, the controller is a Programmable Logic Controller (PLC) with a pre-programmed algorithm for receiving and transmitting signals.

In another embodiment of the present invention, the controller is comprised of a set of electrical relays and contactors.

The distance between the movable mandrels and the stationary mandrels of the outer and the inner moulding units is fixed and this distance is adjustable depending on the diameter of the reinforcement section being machined.

The distance between the first mounting platform and the second mounting platform, as well as the distance between the ends of the reinforcement section and the outer moulding units, is adjustable depending on the dimensions of the reinforcement chairs produced.

The above objects of the present invention are also accomplished by a method for producing reinforcement blanks of the type of reinforcement chair, carried out by the automatic machine according to the present invention, the method comprises the following steps: a steel reinforcement section of predetermined length, corresponding to the total length of a reinforcement blank of the type of a reinforcement chair, is inserted in the slits formed between the each of the stationary mandrels and the respective movable mandrels of the outer and the inner moulding units and also in the slit of the reinforcement section locking mechanism, a signal from the controller is transmitted to the two outer moulding units, starting the power mechanisms of the two outer moulding units for simultaneously rotation the two outer movable mandrels around the outer stationary mandrels, pressing and bending the reinforcement section in two diametrically opposite directions, until the bending edges of the reinforcement section reach a predetermined angle relative to the original longitudinal axis of the reinforcement section, to simultaneously form the two support legs of the reinforcement chair in mutually opposite directions, a signal from the sensors controlling the outer moulding units is transmitted to the controller, starting the power mechanisms of the two inner moulding units for simultaneously rotation the movable mandrels around the stationary mandrels to bend the parts of the reinforcement section located between the outer stationary mandrels and the stationary mandrels of the inner moulding units, to simultaneously form the vertical supports of the reinforcement chair, a signal from the controller is transmitted to the reinforcement section locking mechanism to release the formed reinforcement chair and to remove said reinforcement chair from the working area of the automatic machine.

The control of the angle of bending of the reinforcement section by means of the sensors is carried out by directly controlling the angle at which the shaft of the power mechanism rotates, respectively the angle of rotation of the arm that connects the stationary mandrel with the movable mandrel, or by controlling the position of the bending portion of the reinforcement section, or by controlling the number of revolutions of the motor when using a servomotor and/or hydraulic motor and/or pneumatic motor as a power mechanism.

The advantages of the automatic machine and the method for producing reinforcement blanks according to the present invention are the following:

simplified design of the automatic machine leading to reliable operation and the ability to automatically control the process;

high process productivity thanks to the simultaneous bending of the support legs as well as the simultaneous bending of the vertical supports of the reinforcement chair, without movement of the bending units relative to each other and of the reinforcement section during the production of the reinforcement chair;

high quality of the reinforcement chairs produced, as the automatic machine ensures strict adherence to the dimensions of the chair thanks to the precise mechanical fixation of the distances between the mandrels;

the automatic machine and the method according to the present invention provide an opportunity to utilize metal residues of rod material and convert them into suitable products.

MODES FOR CARRYING OUT THE INVENTION

Figure 1:
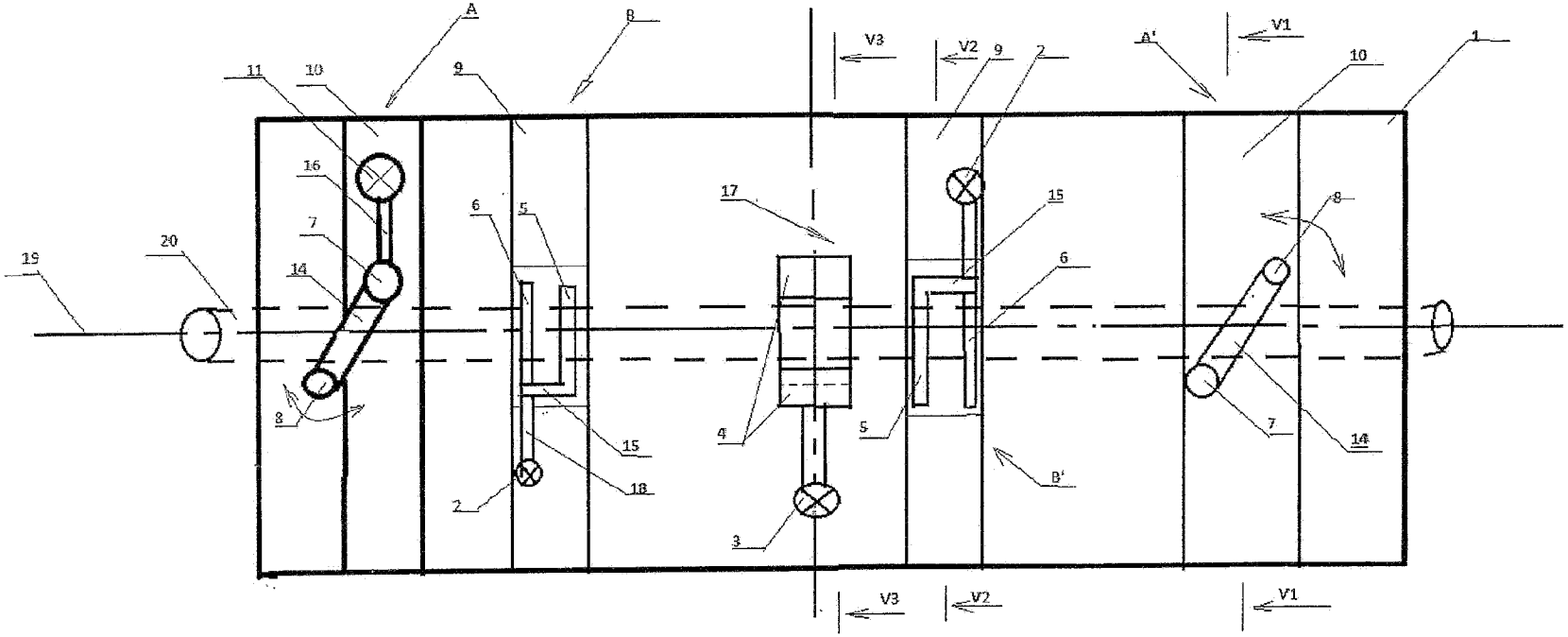
FIG. 1 is a schematic top view of an automatic machine for producing reinforcement blanks of the type of reinforcement chair according to the invention.

An automatic machine for the production of reinforcement blanks of the type of reinforcement chair of a steel reinforcement section 20, shown schematically on FIG. 1, consists of a moulding module and a reinforcement section locking mechanism 17. The moulding module comprises two outer moulding units A and A' and two inner moulding units B and B', mounted on a support beam 1. Each of the outer moulding units A and A', shown on FIG. 1, FIG. 2 and FIG. 2*a*, comprises a pair of mandrels—an outer stationary mandrel 7 and an outer movable mandrel 8 with parallel arranged longitudinal axes. The pair of mandrels of the two outer moulding units A and A' are arranged relative to each other in such a way that they are capable of bending the ends of the reinforcement section in opposite direction to form the legs of the reinforcement chair. The outer stationary mandrel 7 of the moulding unit A and the outer movable mandrel 8 of the moulding unit A' are arranged on the one side of the longitudinal axis 19 of the support beam 1 and the outer movable mandrel 8 of the moulding unit A and the outer stationary mandrel 7 of the moulding unit A'—on the other side of the longitudinal axis 19. Each of the outer movable mandrels 8 is attached at one end to an arm 14 and the outer stationary mandrel 7 is attached immovably at the other end of the arm 14, which is connected by a shaft 16 to a power mechanism 11 to rotate the stationary mandrel 7 around its axis. The power mechanism 11 is attached immovably to the mounting platform 10 (the attachment is not shown in the figures), which in turn is attached immovably to the support beam 1 by means of a locking mechanism 12.

Figure 2:
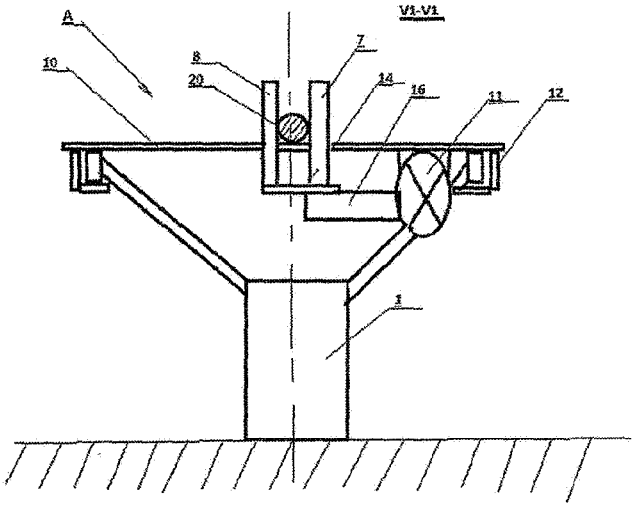
FIG. 2 is a cross-sectional view through an outer moulding unit of V1-V1 of FIG. 1, when bending the reinforcement section upwards to form the legs of the reinforcement chair.
Figure 2A:
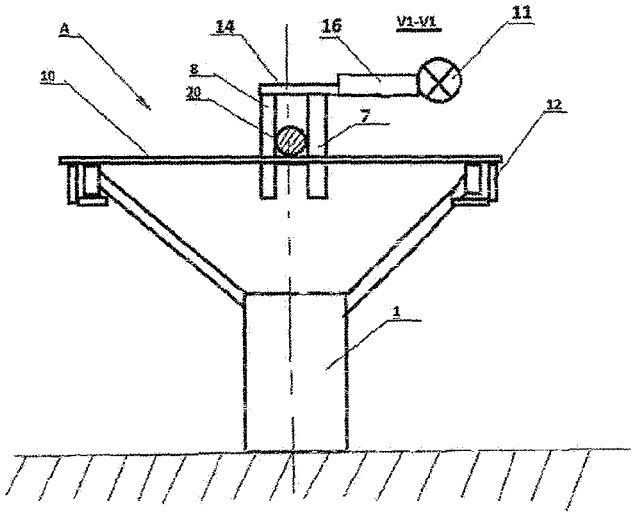
FIG. 2*a* is a cross-sectional view through an outer moulding unit of V1-V1 of FIG. 1 in another embodiment of the invention—when bending the reinforcement section downwards to form the legs of the reinforcement chair.

FIG. 2 shows the arrangement of the mandrels 7 and 8 and the arm 14 of the outer moulding units A and A', when the reinforcement section 20 is bent upwards relative to the mounting platform 10. In this embodiment, the arm 14 connecting the outer stationary mandrel 7 and the outer movable mandrel 8 is positioned below the level of the mounting platform 11 and the reinforcement section 20. FIG. 2*a* shows the arrangement of the mandrels 7 and 8 and the arm 14 of the outer moulding units A and A', when the reinforcement section 20 is bent downwards relative to the mounting platform 10. In this embodiment, the arm 14 connecting the outer stationary mandrel 7 and the outer movable mandrel 8 is positioned above the level of the mounting platform 10 and the reinforcement section 20.

Each of the two inner moulding units B and B' (FIG. 1, FIG. 3 and FIG. 3*b*) consists of a pair of mandrels—a stationary mandrel 6 located on the side of the outer moulding unit A, respectively A', and a movable mandrel 5, with the axis of the two mandrels 6 and 5 being parallel to each other and lying in a perpendicular plane relative to the plane of the outer moulding mandrels 7 and 8. The distance between the axes of each of the outer stationary mandrels 7 of the outer moulding units A and A' and each of the stationary mandrels 6 of the inner moulding units B and B' is equal to the length of each of the vertical supports of the chair. The distance between the axes of the two stationary mandrels 6 of the inner moulding units B and B' is equal to the length of the upper horizontal part of the chair. Each of the movable mandrels 5 is attached at one end to a second arm 15 and the stationary mandrel 6 is attached immovably at the other end of said arm 15 and is connected by a second shaft 18 to a second power mechanism 2 to rotate the stationary mandrel 6 around its axis. The second shaft 18 is connected by a spline connection to the movable mandrel 5 or is attached immovably to the movable mandrel 5 to rotate it around the stationary mandrel 6 and bend the reinforcement section 20. The second power mechanism 2 is attached immovably to the second mounting platform 9, which in turn is attached immovably to the support beam 1 by means of a second locking mechanism 13.

Figure 3:
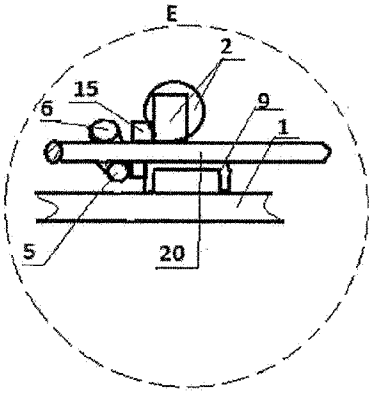
FIG. 3 is a cross-sectional view through an inner moulding unit of V2-V2 of FIG. 1, when bending the reinforcement section upwards to form the vertical supports of the reinforcement chair.
Figure 3:
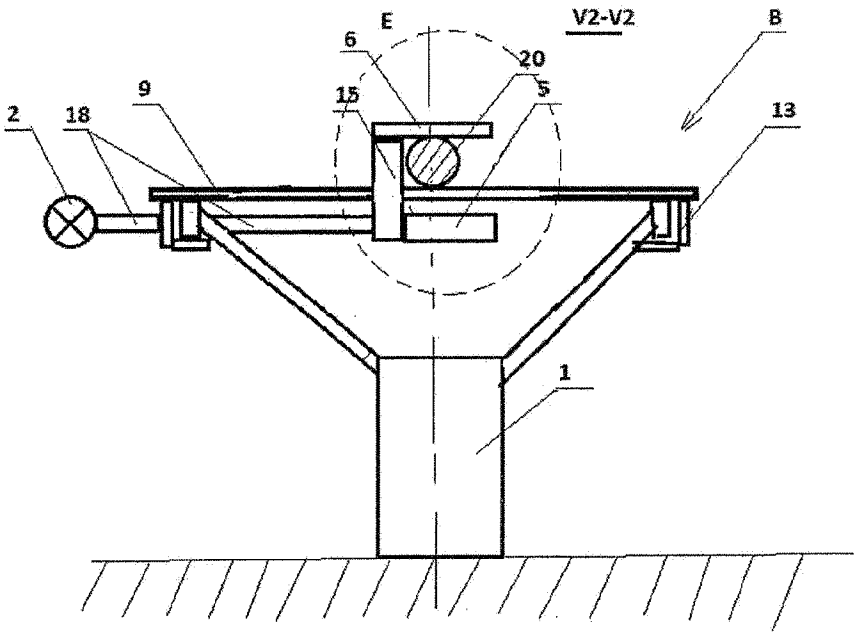
Figure 3B:
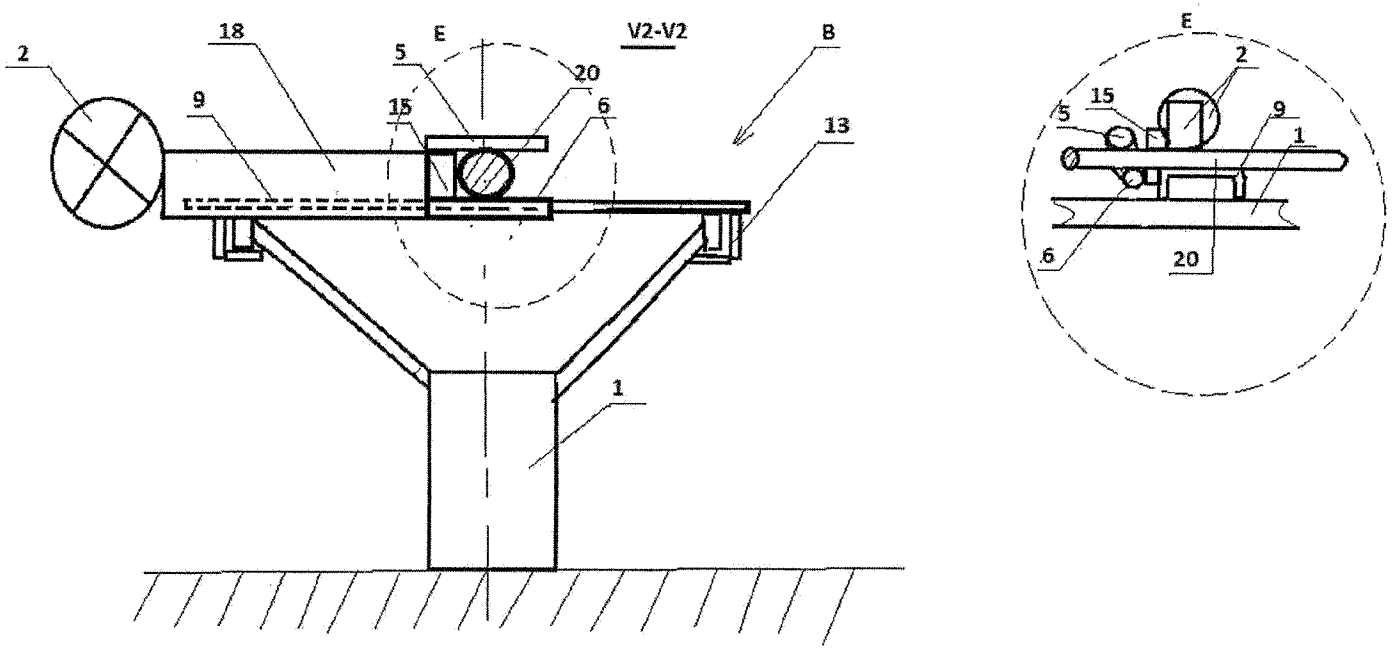
FIG. 3*b* is a cross-sectional view through an inner moulding unit of V2-V2 of FIG. 1 in another embodiment, when bending the reinforcement section downwards to form the vertical supports of the reinforcement chair.

FIG. 3 and FIG. 3*b* show embodiments, wherein each of the movable mandrels 5 and the stationary mandrels 6 of the inner moulding units B and B' is positioned laterally on the second mounting platform 9 on the side of the reinforcement section locking mechanism 17 in close proximity and at a minimum distance from the end of the second mounting platform 9. When the reinforcement section 20 is bent upwards to form the vertical supports of the chair, the stationary mandrel 6 is positioned above the reinforcement section 20, while the movable mandrel 5 is positioned below the reinforcement section 20 (FIG. 3). When selecting a direction of bending of the reinforcement section 20 downwards to form the two vertical supports of the chair (FIG. 3*b*), each of the two stationary mandrels 6 of the inner moulding units B and B' is positioned below the reinforcement section 20, with the upper end of the stationary mandrel 6 lying in one plane with the upper end of the second mounting platform 9, and each of the movable mandrels 5 is positioned above the reinforcement section 20.

In the above embodiments, the power mechanisms 2 and 11 are servomotors. In other embodiments, other types of known power mechanisms may be used such as pneumatic cylinders, hydraulic cylinders, electric motors, pneumatic motors, hydraulic motors, and combination thereof.

Figure 4:
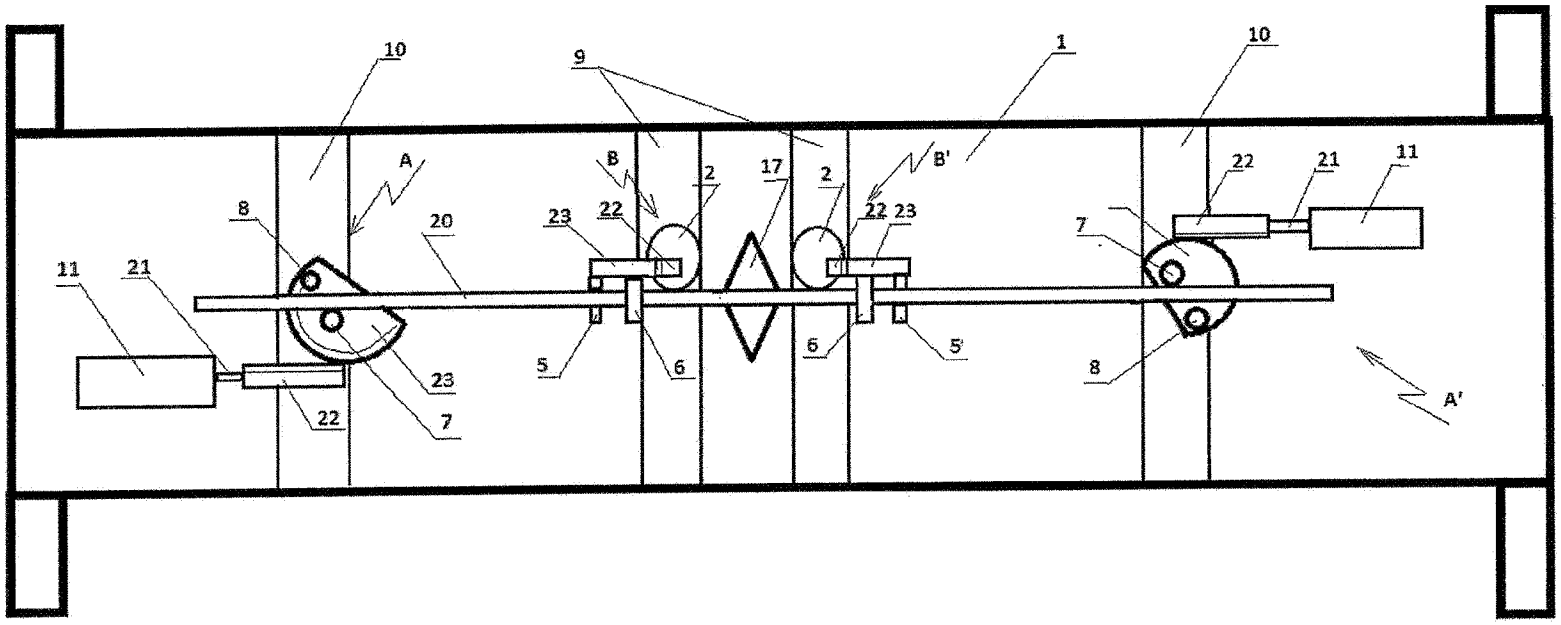
FIG. 4 is a schematic top view of an automatic machine for producing reinforcement blanks of the type of reinforcement chair according to another embodiment of the invention, using hydraulic/pneumatic cylinders as power mechanisms.

FIG. 4 shows an embodiment of the present invention, wherein the power mechanisms are pneumatic or hydraulic cylinders 11, 2. To the piston rod 21 of each hydraulic or pneumatic cylinder 11, 2 a gear rack 22 is attached, engaged at a gear platform 23, with mandrels attached thereto—an outer stationary mandrel 7 for each of the outer moulding units A and A' and a stationary mandrel 6 for the inner moulding units B, B'. Said stationary mandrels 7 and 6 are located at the centre of the respective gear platform 23 and bearing to the respective mounting platforms 10 and 9, while the movable mandrels 8, respectively 5, are located at a distance from the stationary mandrels 7, respectively 6 and are capable of rotating around the stationary mandrels 7 and 6 when rotating the gear platform 23. When selecting a direction of bending of the reinforcement section 20 upwards to form the two vertical supports of the chair, each of the two movable mandrels 5 of the inner moulding units B, B' is positioned below the reinforcement section 20, with the lower end of the stationary mandrel 6 lying above the upper end of the reinforcement section 20. When selecting a direction of bending of the reinforcement section 20 downwards to form the two vertical supports of the chair, each of the two movable mandrels 5 of the inner moulding units B, B' is positioned above the reinforcement section 20 and each of the stationary mandrels 6 is positioned below the reinforcement section 20 (this arrangement of mandrels 5 and 6 is not shown in the Figures).

The mandrels of the moulding units A, A' and B, B' are arranged so that slits between the stationary mandrels 7, 6 and the respective movable mandrels 8, 5 of the moulding units A, A' and B, B' are formed to insert the reinforcement section 20. The distance between the movable mandrel 8, 5 and the respective stationary mandrel 7, 6 of the each of the outer and the inner moulding units A, A' and B, B' is fixed for the given diameter of the reinforcement section and said distance is adjustable when the diameter of the machined reinforcement section 20 can be changed by changing the position of the movable mandrels relative to the respective stationary mandrels or by positioning said mandrels on the arm 14, respectively on the second arm 15.

Figure 5:
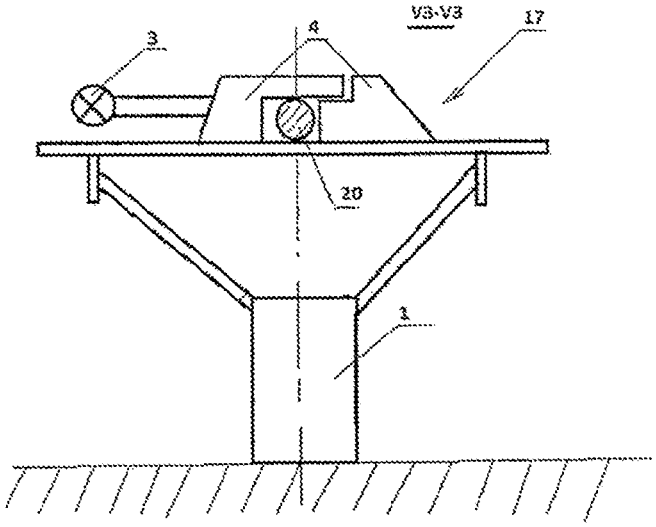
FIG. 5 is a cross-sectional view through a reinforcement section locking mechanism of V3-V3 of FIG. 1.

FIG. 5 shows a schematic view of the reinforcement section locking mechanism 17, positioned between the two inner moulding units B and B', said section locking mechanism 17 consists of a jaw 4 composed of two steel bodies, in one of which a protruding part is formed and in the other steel body, opposite to the protruding part, a concave part is formed, wherein the one steel body is attached immovably to the support beam 1 and the other steel body is capable of sliding on a bed attached immovably to the support beam 1 (not shown in the Figure) by a third power mechanism 3 connected to the steel body. In closed position, a slit between the two steel bodies is formed to insert and fix the reinforcement section 20 to the support beam 1, said slit is equidistant from the central axes of the stationary mandrels 6 of the two inner moulding units B and B'. Other types of reinforcement section locking mechanisms may also be used (not shown in the Figures), for example jaw vice, sliding plates arranged under and above the reinforcement section, clips, support plate and pressure through another plate above the reinforcement section.

On each of the mounting platforms 9 and 10 of the moulding units A, A' and B, B', sensors are installed (not shown in the Figures) to adjust the angle of bending of the reinforcement section 20. In another embodiment, the sensors are installed on the power mechanisms 11 and 2 of each of the outer and inner moulding units A, A' and B, B'.

The automatic machine is provided with a controller (not shown in the Figures), which may be a computer or another electronic component. In this example, the controller is a Programmable Logic Controller (PLC) with a pre-programmed algorithm for receiving and transmitting signals. In another embodiment of the invention, the controller is comprised of a set of electrical relays and contactors.

In one embodiment, the support beam 1 is composed of two adjacent parts located to each other (not shown in the Figures), on which the two mounting platforms are mounted.

A method of producing reinforcement blanks of the type of reinforcement chair carried out by the automatic machine according to the embodiments described above, the method comprising the following steps:

A steel reinforcement section 20 of a predetermined length, corresponding to the total length of a reinforcement blank of the type of reinforcement chair, previously obtained by cutting straight rods or straightened and cut coiled steel, is inserted in the slits formed between the mandrels of the outer and the inner moulding units A, A' and B, B', and also in the slit of the reinforcement section locking mechanism 17. The distance between the ends of the reinforcement section and the axes of the outer stationary mandrels 7 determines the dimension of each of the two legs of the reinforcement chair. By positioning the steel reinforcement section 20 in the described position, the machine is ready to start the bending process;

a signal from the controller is transmitted to the two outer moulding units A, A', starting the power mechanisms 11 of the two outer moulding units A, A' to transmit torque by the shafts 16 and the arms 14 to the two outer movable mandrels 8 for simultaneously rotation the two outer movable mandrels 8 around the respective outer stationary mandrels 7 along an arcuate path, pressing and bending the edges of the reinforcement section positioned between them to simultaneously form the two support legs of the chair at right angle and in mutually opposite directions relative to the original longitudinal axis of the reinforcement section 20;

a signal from the sensors controlling the outer moulding units A, A' is transmitted to the controller, starting the power mechanisms 2 of the two inner moulding units B, B' to transmit torque by the shafts 18 and the arms 15 to the movable mandrels 5, for simultaneously rotation the movable mandrels 5 around the stationary mandrels 6 to bend the parts of the reinforcement section 20 located between the outer stationary mandrels 7 and the stationary mandrels 6 of the inner moulding units B, B' at right angle relative to the original longitudinal axis of the reinforcement section to simultaneously form the two vertical supports of the reinforcement chair, lying in a plane perpendicular to the plane in which the already formed legs of the chair lie; the upper horizontal part of the chair in the area of the reinforcement section engaged by the locking mechanism 17 remains immovable while bending the legs and the vertical supports of the chair, as the reinforcement section locking mechanism 17 does not allow the upper horizontal part to bend in order to maintain its parallelity in relation to the legs;

a signal from the controller is transmitted to the reinforcement section locking mechanism 17 to release the formed reinforcement chair from the automatic machine by moving the movable part of the jaw 4 in the rearmost position and then removing the chair from the working area of the machine, after which all mechanisms are returned to the starting position to repeat the cycle.

In another embodiment, when reaching the predetermined angle of bending of the reinforcement section 20 by the outer moulding units A and A' and immediately after the initial phase of bending by the inner moulding units B and B', through a signal from the controller, the outer moulding units A and A' are returned to the starting position. Also, immediately after bending the reinforcement section 20 to a predetermined angle by the inner moulding units B and B', they are returned to the starting position before removing the chair from the working area of the automatic machine.

When the automatic machine is assembled with an automatic feeder of sections of reinforcement blank of rod material or straightened coiled steel, the signal from the controller is used to start the new cycle until the set number of chairs is produced.

When producing preset size chair, the two mounting platforms 9 and 10 are fixed to the support beam 1, and their mounting to the support beam 1 is carried out in such a way that they can be moved relative to each other as needed. Changing the distance between the two mounting platforms 9 and 10 changes the length of the vertical supports; changing the position of the mounting platforms 10 of the moulding units A and A' relative to the ends of the reinforcement section 20 changes the length of the legs; and the distance between the two platforms 9 serves to change the length of the upper horizontal part of the chair. The possibility of adjusting the distance between the moulding units enables the production of reinforcement blanks of various sizes and in particular of different size chairs.

Figure 6:
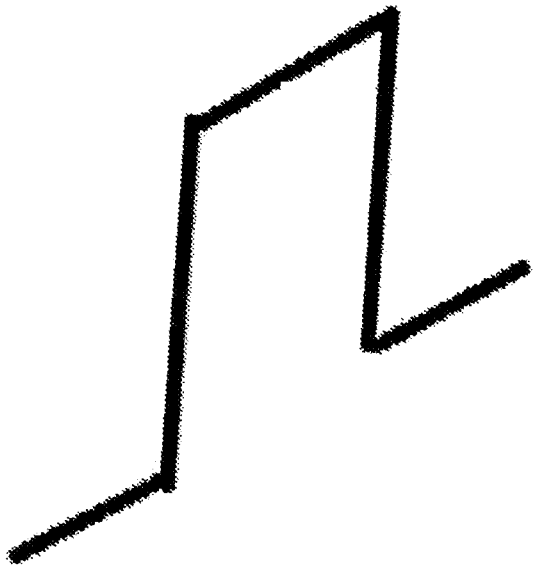
FIG. 6 is an axonometric view of a reinforcement blank of the type of reinforcement chair.

FIG. 6 shows a reinforcement chair formed by the automatic machine according to the invention.

INDUSTRIAL APPLICABILITY

The automatic machine and the method of producing reinforcement blanks according to the present invention are used for the production of reinforcement chairs. However, it will be apparent to a person skilled in the art that the automatic machine can also be used in the production of other types of reinforcement blanks, such as single-sided bending shapes (L-shape), mainly at small element lengths, which makes them unsuitable for machining by most of the known automated machines in view of the limitation of the minimum lengths of the straight section that is required for the aforementioned automated machines to make this type of reinforcement blanks. It will also be apparent to a person skilled in the art that, if the operation of the outer moulding units is shut down, it will still be possible to produce shapes of reinforcement blanks other than a chair through the inner moulding units, for example L-shape, P-shape, brackets.

The invention claimed is:

1. An automatic machine for producing reinforcement blanks, comprising:

a moulding module including two outer moulding units (A, A') and two inner moulding units (B, B'), as well as a reinforcement section locking mechanism positioned between the two inner moulding units (B, B') and mounted on a support beam, wherein each of the outer moulding units (A, A') comprises a pair of mandrels with parallel longitudinal axes, said pair of mandrels including an outer stationary mandrel and an outer movable mandrel, each of the outer movable mandrel being fixed at one end to an arm and the outer stationary mandrel being fixed at the other end of the arm and connected by a shaft to a first power mechanism to rotate the stationary mandrel around its axis, the first power mechanism being mounted immovably on a mounting platform, which is fixed to the support beam, and the pair of mandrels of the two outer moulding units (A, A') are arranged relative to each other in such a way that they are capable of bending the ends of the reinforcement section in two mutually opposite directions, each of the two inner moulding units (B, B') including a pair of mandrels with parallel longitudinal axes, said pair of mandrels including an inner stationary mandrel and an inner movable mandrel, and a plane passing through the longitudinal axes of the two inner mandrels being perpendicular to a plane passing through the longitudinal axes of the outer mandrels, each of the inner movable mandrels being fixed at one end to a second arm and the inner stationary mandrel being fixed at the other end of the arm and connected by a second shaft to a second power mechanism to rotate the inner stationary mandrel around its axis, the second power mechanism being attached immovably to a second mounting platform, which in turn is attached immovably to the support beam, wherein the mandrels of the inner and the outer moulding units (A, A' and B, B') are positioned in such a way that slits are formed between the stationary mandrels and the respective movable mandrels of each of the moulding units (A, A' and B, B') to insert a reinforcement section;

the automatic machine being provided with a controller and sensors for controlling the angle of bending of the reinforcement section installed on each of the outer and the inner moulding units (A, A' and B, B') and on the reinforcement section locking mechanism, said sensors being connected to the controller of the automatic machine.

2. The automatic machine according to claim 1, when the reinforcement section is bent upwards relative to the mounting platform to form the legs of the reinforcement chair, the arm connecting the outer stationary mandrel and the outer movable mandrel of each of the outer moulding units (A, A') is positioned below the level of the mounting platform and the reinforcement section, whereas when the reinforcement section is bent downwards relative to the mounting platform, the arm is positioned above the level of the mounting platform and the reinforcement section.

3. The automatic machine according to claim 1, the movable mandrels and the stationary mandrels of the inner moulding units (B and B') are positioned laterally on the second mounting platform on the side of the reinforcement section locking mechanism in close proximity and at a minimum distance from the end of the second mounting platform, whereas when the reinforcement section is bent upwards to form the two vertical supports of the reinforcement chair, each of the two stationary mandrels is positioned above the reinforcement section and each of the movable mandrels is positioned below the reinforcement section; when the reinforcement section is bent downwards, each of the two stationary mandrels is positioned below the reinforcement section, with the upper end of the stationary mandrel lying in one plane with the upper end of the second mounting platform, and each of the movable mandrels is positioned above the reinforcement section.

4. The automatic machine according to claim 1, the power mechanisms are hydraulic cylinders and/or pneumatic cylinders and/or hydraulic motors and/or servomotors and/or electric motors and/or pneumatic motors.

5. The automatic machine according to claim 1, the reinforcement section locking mechanism, located between the two inner moulding units (B, B'), consists of a jaw comprising at least one pair of steel bodies, in one of which a protruding part is formed and in the other steel body, opposite to the protruding part, a concave part is formed, wherein one of the steel bodies is attached immovably to the support beam and the other steel body is capable of sliding on a bed, attached to the support beam, by means of a third power mechanism connected to the steel body, wherein in a closed position a slit is formed between the two steel bodies for positioning and fixing the reinforcement section to the support beam.

6. The automatic machine according to claim 1, the controller is a Programmable Logic Controller (PLC) with pre-programmed algorithm for receiving and transmitting signals.

7. The automatic machine according to claim 1, the controller is composed of a set of electrical relays and contactors.

8. The automatic machine according to claim 1, a distance between the movable mandrel and the respective stationary mandrel of the each of the outer and the inner moulding units (A, A' and B, B') is adjustable depending on a diameter of the reinforcement section.

9. The automatic machine according to claim 1, the distance between the first mounting platform and the second mounting platform is adjustable depending on the height of the vertical supports of the reinforcement chairs produced.

10. A method for producing reinforcement blanks carried out by the automatic machine according to claim 1, comprising:

inserting a steel reinforcement section of predetermined length, corresponding to the total length of a reinforcement blank of the type of a reinforcement chair, in the slits formed between the each of the stationary mandrels and the respective movable mandrels of the outer and the inner moulding units (A, A' and B, B') and also in a slit of the reinforcement section locking mechanism, transmitting a signal from the controller to the two outer moulding units (A, A'), starting the power mechanisms of the two outer moulding units (A, A') for simultaneously rotation the two outer movable mandrels around the outer stationary mandrels, pressing and bending the reinforcement section in two diametrically opposite directions, until the bending edges of the reinforcement section reach a predetermined angle relative to the original longitudinal axis of the reinforcement section for simultaneously forming the two support legs of the reinforcement chair in mutually opposite directions, transmitting a signal from the sensors controlling the outer moulding units (A, A') to the controller, starting the power mechanisms of the two inner moulding units (B, B') for simultaneously rotation the movable mandrels around the stationary mandrels to bend the parts of the reinforcement section located between the outer stationary mandrels and the stationary mandrels of the inner moulding units (B, B'), to simultaneously form the vertical supports of the reinforcement chair, and transmitting a signal from the controller to the reinforcement section locking mechanism to release the formed reinforcement chair and to remove it from the working area of the automatic machine.

11. The method according to claim 10, the control of an angle of bending of the reinforcement section by the sensors is carried out by one of directly controlling an angle of rotation of the respective power mechanism shaft, respectively an angle of rotation of the arm connecting the inner or outer stationary mandrel with the respective inner or outer movable mandrel, or by controlling the position of the bending portion of the reinforcement section, or controlling revolutions of one or more of a group including hydromotors, pneumomotors, and electric motors.

* * * * *